US007479842B2

(12) United States Patent
Gaucher et al.

(10) Patent No.: US 7,479,842 B2
(45) Date of Patent: Jan. 20, 2009

(54) APPARATUS AND METHODS FOR CONSTRUCTING AND PACKAGING WAVEGUIDE TO PLANAR TRANSMISSION LINE TRANSITIONS FOR MILLIMETER WAVE APPLICATIONS

(75) Inventors: Brian P. Gaucher, Brookfield, CT (US); Janusz Grzyb, Ossining, NY (US); Duixian Liu, Scarsdale, NY (US); Ullrich R. Pfeiffer, Yorktown Heights, NY (US); Thomas M. Zwick, Kisslegg (DE)

(73) Assignee: International Business Machines Corporation, Armonk, NY (US)

( * ) Notice: Subject to any disclaimer, the term of this patent is extended or adjusted under 35 U.S.C. 154(b) by 204 days.

(21) Appl. No.: 11/395,098

(22) Filed: Mar. 31, 2006

(65) Prior Publication Data

US 2007/0229182 A1 Oct. 4, 2007

(51) Int. Cl.
*H01P 5/107* (2006.01)

(52) U.S. Cl. ..... 333/26; 333/246

(58) Field of Classification Search ..... 333/26, 333/246

See application file for complete search history.

(56) References Cited

U.S. PATENT DOCUMENTS

| | | | | | |
|---|---|---|---|---|---|
| 3,157,847 | A | * | 11/1964 | Williams | 333/239 |
| 3,924,204 | A | * | 12/1975 | Fache et al. | 333/21 R |
| 4,754,239 | A | * | 6/1988 | Sedivec | 333/26 |
| 5,361,049 | A | * | 11/1994 | Rubin et al. | 333/26 |
| 5,773,887 | A | * | 6/1998 | Pavio et al. | 257/728 |
| 6,002,305 | A | * | 12/1999 | Sanford et al. | 333/26 |
| 6,987,429 | B2 | * | 1/2006 | Shih et al. | 333/26 |
| 7,002,431 | B2 | * | 2/2006 | Lenz et al. | 333/26 |

* cited by examiner

*Primary Examiner*—Benny Lee
(74) *Attorney, Agent, or Firm*—F. Chau & Associates, LLC

(57) ABSTRACT

Apparatus and methods are provided for constructing waveguide-to-transmission line transitions that provide broadband, high performance coupling of power at microwave and millimeter wave frequencies. More specifically, exemplary embodiments of the invention include wideband, low-loss and compact coplanar waveguide-to-rectangular waveguide transition structures and asymmetric coplanar stripline (or coplanar stripline)-to-rectangular waveguide transition structures that are particularly suitable for microwave and millimeter wave applications.

14 Claims, 10 Drawing Sheets

APPARATUS AND METHODS FOR CONSTRUCTING AND PACKAGING WAVEGUIDE TO PLANAR TRANSMISSION LINE TRANSITIONS FOR MILLIMETER WAVE APPLICATIONS

TECHNICAL FIELD OF THE INVENTION

The present invention relates to apparatus and methods for constructing waveguide-to-transmission line transitions that provide broadband, high performance coupling of power at microwave and millimeter wave frequencies. The present invention further relates to apparatus and methods for constructing compact wireless communication modules in which microwave integrated circuit chips and/or modules are integrally packaged with waveguide-to-transmission line transition structures providing a modular component that can be mounted to a standard waveguide flange.

BACKGROUND

In general, microwave and millimeter-wave (MMW) communication systems are constructed with various components and subcomponents such as receiver, transmitter, and transceiver modules, as well as other passive and active components, which are fabricated using MIC (Microwave Integrated Circuit) and/or MMIC (Monolithic Microwave Integrated Circuit) technologies. The system components/subcomponents can be interconnected using various types of transmission media such as printed transmission lines (e.g., microstrip, slotline, CPW (coplanar waveguide), CPS (coplanar stripline), ACPS (asymmetric coplanar stripline), etc.) or coaxial cables and waveguides.

Printed transmission lines are widely used in microwave and MMW circuits to provide package-level or circuit board-level interconnects between semiconductor chips (RF integrated circuits) and between semiconductor chips and transmitter or receiver antennas. Moreover, printed transmission lines are well suited for signal propagation on the surface of a semiconductor integrated circuit. For instance, CPW transmission lines are widely used in MMIC designs due to their uniplanar nature, low dispersion and high compatibility with active and passive devices. However, printed transmission lines may be subject to parasitic modes and increased losses at high frequencies. On the other hand, metallic waveguides (e.g., rectangular, circular, etc.) are suitable for signal transmission over larger distances and at high power levels in a low-loss manner. Furthermore, waveguides may be shaped into a highly directive antennas or may be used for device characterization.

When constructing microwave, RF or MMW systems, it may be necessary to couple a printed transmission line with a waveguide using a coupling structure referred to a "transition". Transitions are essential for integrating various components and subcomponents into a complete system. The most common transmission line-to-waveguide transitions are microstrip-to-waveguide transitions, which have been widely studied. While considerable research and development has been dedicated to such transitions, comparatively less effort has been applied to establish suitable transitions from CPW, CPS or ACPS transmission lines to rectangular waveguides. CPW and CPS transmission lines are particularly suitable (over microstrip) for high integration density MIC and MMIC designs. In this regard, it is highly desirable to develop broadband, low-loss and well matched transitions between waveguides and CPW or CPS printed transmission lines or monolithic microwave integrated circuits (MMICs) which can be used to design high performance systems.

SUMMARY OF THE INVENTION

Exemplary embodiments of the invention generally includes apparatus and methods for constructing waveguide-to-transmission line transitions that provide broadband, high performance coupling of power at microwave and millimeter wave frequencies. More specifically, exemplary embodiments of the invention include wideband, low-loss and compact CPW-to-rectangular waveguide transition structures and ACPS (or CPS)-to-rectangular waveguide transition structures that are particularly suitable for microwave and millimeter wave applications.

More specifically, in one exemplary embodiment of the invention, a transition apparatus includes a transition housing and transition carrier substrate. The transition housing has a rectangular waveguide channel and an aperture formed through a broad wall of the rectangular waveguide channel. The substrate has a planar transmission line and a planar probe formed on a first surface of the substrate. The planar transmission line includes a first conductive strip and a second conductive strip, wherein the planar probe is connected to, and extends from, an end of the first conductive strip, and wherein an end of the second conductive strip is terminated by a stub. The substrate is positioned in the aperture of the transition housing such that the printed probe protrudes into the rectangular waveguide channel at an offset from a center of the broad wall and wherein the ends of the first and second conductive strip are aligned to an inner surface of the broad wall of the rectangular waveguide channel.

The printed transmission line may be a CPS (coplanar stripline), an ACPS (asymmetric coplanar stripline) or a CPW (coplanar waveguide). One end of the rectangular waveguide channel is close-ended and provides a backshort for the probe. In one exemplary embodiment, the backshort is adjustable. Another end of the rectangular waveguide channel is opened on a mating surface of the transition housing. The mating surface can interface with a rectangular waveguide flange. The transition housing may be formed from a block of metallic material. Alternatively, the transition housing can be formed from a plastic material having surfaces that are coated with a metallic material.

In another exemplary embodiment of the invention, the aperture of the transition housing is designed with a stepped-width opening to enable alignment and positioning of the substrate in the aperture and the rectangular waveguide channel.

In yet another exemplary embodiment of the invention, the stub at the end of the second conductive strip is connected to edge wrap metallization for parasitic mode suppression. The edge wrap metallization may be electrically connected to a metallic surface of the transition housing. The edge wrap metallization may be connected to a ground plane on a second surface of the substrate. The edge wrap metallization may be galvanically isolated from the transition housing.

In yet another embodiment of the invention, the transition housing includes a tuning cavity formed on a second broad wall of the rectangular waveguide channel opposite and aligned to the aperture. The tuning cavity can be shorted by an adjustable backshort element to provide a mechanism for impedance matching.

Exemplary embodiments of the invention further includes apparatus and methods for constructing compact wireless communication modules in which microwave integrated circuit chips and/or modules are integrally packaged with waveguide-to-transmission line transition structures providing a modular component that can be mounted to a standard waveguide flange.

These and other exemplary embodiments, aspects, features and advantages of the present invention will be described or become apparent from the following detailed description of exemplary embodiments, which is to be read in connection with the accompanying drawings.

DETAILED DESCRIPTION OF EXEMPLARY EMBODIMENTS

Figure 1B:
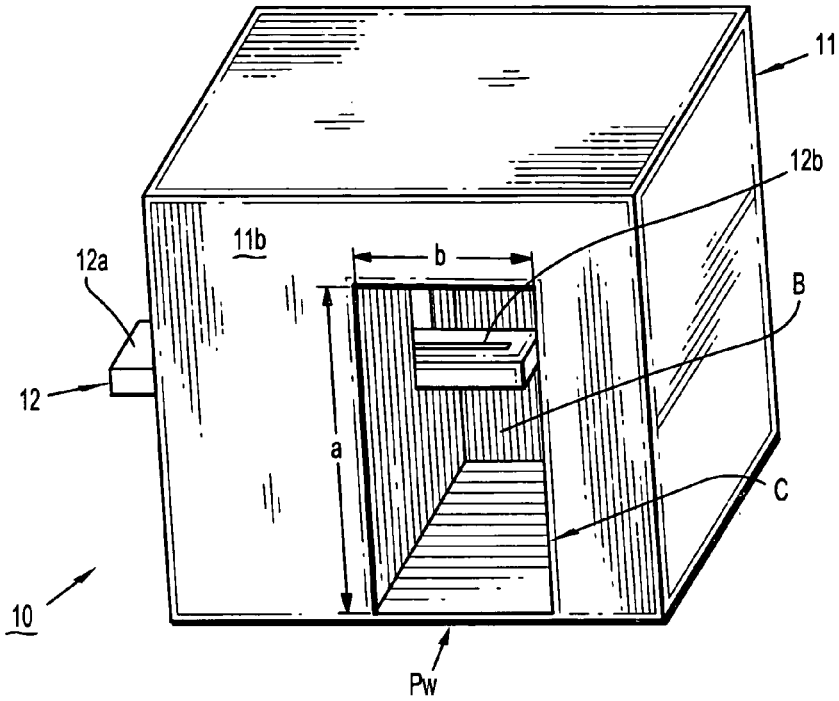
FIGS. 1A and 1B are schematic perspective views of a transmission line to waveguide transition apparatus (10) according to an exemplary embodiment of the invention.
Figure 1A:
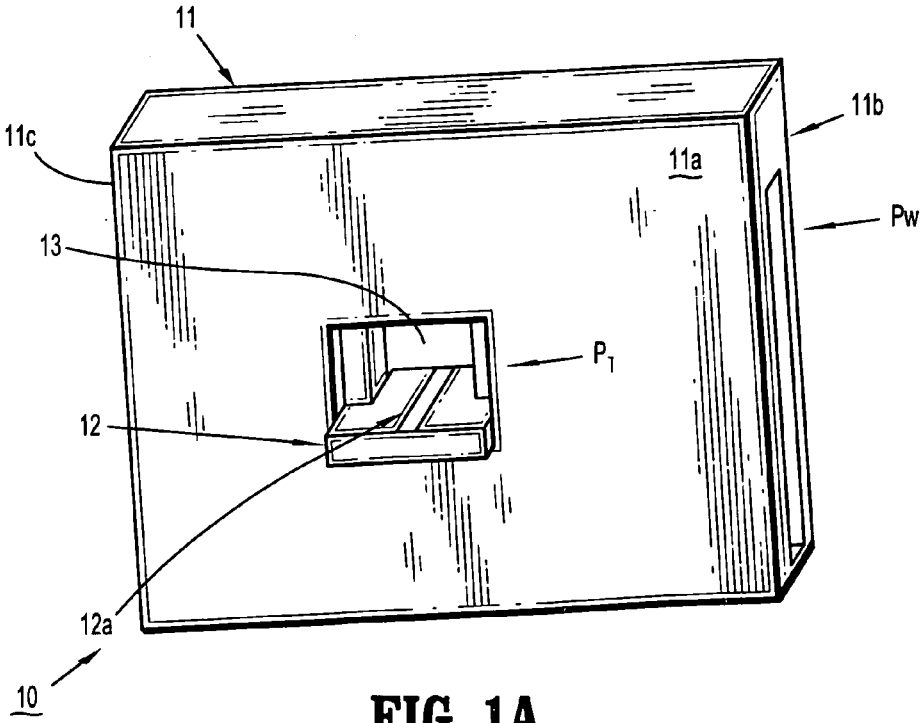

FIGS. 1A and 1B are schematic perspective views of a transmission line to waveguide transition apparatus (10) according to an exemplary embodiment of the invention. More specifically, FIGS. 1A and 1B schematically depict a transition apparatus (10) for coupling electromagnetic signals between a rectangular waveguide (e.g., WR15) and a printed transmission line using an E-plane probe-type transition, according to an exemplary embodiment of the invention. The transition apparatus (10) comprises a metallic transition housing (11) (or waveguide block) which has an inner rectangular waveguide cavity C (or rectangular waveguide channel) of width a (broad wall) and height b (short wall). An aperture (13) is formed in a front wall (11*a*) of the waveguide block (11) through a broad wall of the rectangular waveguide cavity C to provide a transition port $P_T$ for insertion and support of a planar transition substrate (12) having a printed transmission line (12*a*) and printed E-plane probe (12*b*). The transition substrate (12) is positioned in the aperture (13) such that the probe (12*b*) protrudes into the waveguide cavity C through the broad wall of waveguide cavity C. One end of the waveguide cavity C is opened on a side wall (11*b*) of the transition housing (11) to provide a waveguide input port $P_w$, The other end of the waveguide cavity C is short-circuited by sidewall (11*c*) of the transition housing (11), whereby the inner surface of the metallic sidewall (11*c*) serves as a back-short B for the probe (12*b*).

Figure 1C:
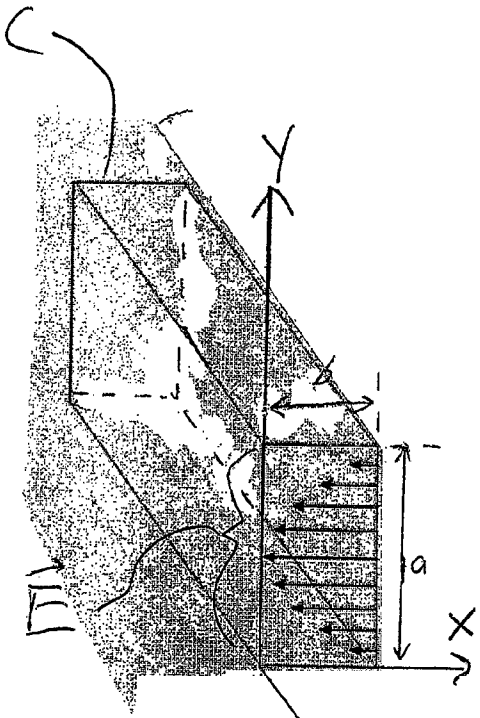
FIG. 1C is a schematic illustration of the rectangular waveguide cavity C illustrating a dominant TE10 propagation mode.

In one exemplary embodiment of the invention, the probe (12*b*) is an E-plane type probe which is designed to sample the electric field within the rectangular waveguide cavity C where the rectangular waveguide is operated in the dominant $TE_{10}$ mode. As is well-known in the art, in a rectangular waveguide, the electric field is normal to the broad sidewall and the magnetic field line is normal to the short sidewall. By way of example, FIG. 1C is a schematic illustration of the rectangular waveguide cavity C where the short sidewalls (b) extend in the x-direction (coplanar with x-z plane), the broad sidewalls (a) extend in the y-direction (coplanar with y-z plane), and where the cavity C extends in the z-direction (i.e., the direction of wave propagation along the waveguide channel). FIG. 1C further illustrates an $\bar{E}$ field for the $TE_{10}$ mode is in the x-y plane (normal to the broad walls) where the maximum positive and negative voltage peaks of the TE wave travel down the center of the waveguide broad walls (a) and the voltage decreases to zero along the waveguide short walls (b).

In this regard, in the exemplary embodiment of FIGS. 1A and 1B, the substrate (12) with the printed probe (12*b*) is inserted through the transition port $P_T$ in the broad sidewall (11*a*) such that the probe (12*b*) is positioned transverse (normal) to the direction of wave propagation (i.e., z-direction in FIG. 1C) and such that the plane of substrate (12) is positioned tangential to the direction of wave propagation (i.e., plane of substrate (12) is coplanar with x-z plane in FIG. 1C). The sidewall (11*c*) of the metal block (11) serves as a back-short B such that the inner surface of the side wall (11*c*) is placed in a certain distance (close to a quarter-wavelength for $TE_{10}$ mode) behind the probe (12*b*) to achieve good transmission properties.

It is to be understood that FIGS. 1A and 1B schematically depict a general framework for a waveguide-to-planar transmission line transition apparatus according to an embodiment of the invention. The printed E-plane probe (12*b*) may have any suitable shape and configuration which is designed to sample the electric field within the rectangular waveguide cavity C. The printed transmission line (12*a*) may be any suitable feed structure such as a printed CPW (coplanar wave guide) feed, ACPS (asymmetric coplanar stripline) feed, or CPS (coplanar stripline) feed. For example, as described in further detail below, FIGS. 4A~4C, 5A~5C and 6~9 illustrate transition structures according to various exemplary embodiments of the invention, which may be constructed with transition substrates having printed conductor-backed and non-conductor backed CPW and CPS feed lines and planar probe transitions, as will be explained in further detail below.

Figure 2:
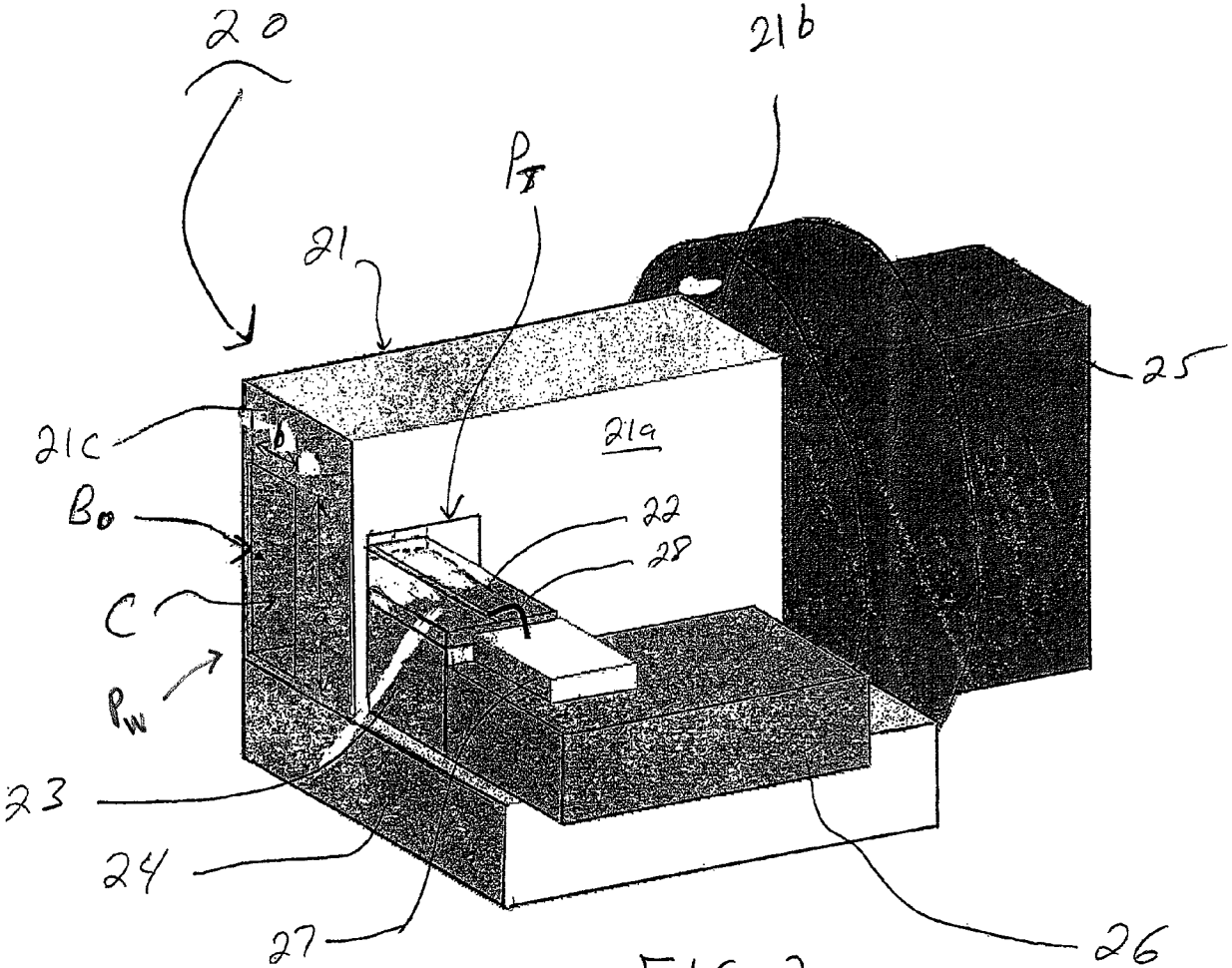
FIG. 2 is a schematic perspective view of a package assembly (20) including a transmission line-to-waveguide transition module that is integrally packaged with external circuitry according to an exemplary embodiment of the invention.

In other exemplary embodiments of the invention, the exemplary transition structure of FIGS. 1A~1B can be integrally packaged with electronic components, such as MIC or MMIC modules to construct compact package structures. For instance, FIG. 2 is a schematic perspective view of a package assembly (20) including a transmission line-to-waveguide transition module that is integrally packaged with external circuitry according to an exemplary embodiment of the invention. The exemplary package (20) includes a transition housing (21) (or waveguide block) having an inner rectangular waveguide channel C. The transition housing (21) has a front wall (21*a*) with an aperture extending through a broad wall of the inner rectangular waveguide channel C providing a transition port $P_T$. A transition substrate (22) with a printed transmission line and E-plane probe is inserted into the waveguide cavity through the transition port $P_T$.

One end of the rectangular waveguide channel C is opened on a sidewall (21*c*) of the transition housing (21) to provide a backshort opening $B_0$, and the other end of the rectangular waveguide channel is opened on a sidewall (21*b*) of the transition housing (21) to provide a waveguide input port $P_w$. The backshort opening $B_o$ on the sidewall (21*c*) of the waveguide housing (21) is formed to allow insertion of a separately fabricated backshort element to short-circuit the end of the waveguide cavity C exposed on the side wall (21*c*), and provide an adjustable E-plane backshort for purposes of impedance matching and tuning the transition.

The transition substrate (22) is supported by a bottom inner surface of the transition port $P_T$ opening and a support block (23) which extends from the front wall (21*a*) of the transition housing (21) and has a top surface that is coplanar with the bottom inner surface of the transition port $P_T$ opening. The transition housing (21) and support block (23) are disposed on a base structure (24). In one exemplary embodiment, the transition housing (21), support block (23) and base plate (24) structures form an integral package housing structure that can be constructed by machining and shaping a metallic block, or such components may be separate components that are bonded or otherwise connected together.

A printed circuit board (26) having a MMIC chip (27) and other RF integrated circuit chips, for example, is mounted on the base (24) such that the surface of the chip (27) is substantially coplanar with the surface of the transition substrate (22). One or more bond wires (28) provide I/O connections between the transmission line feed on the transition substrate (22) and I/O contacts on the chip (27). In the exemplary package design, the plane of substrate (22) is positioned tangential to the direction of wave propagation, which allows the external electronic components to be located in the same plane of the substrate (22), thus, simplifying placement and integration of the components The package structure (20) schematically illustrates a method for integrally packaging a MMW or microwave chip module with a rectangular waveguide launch according to an exemplary embodiment of the invention. The exemplary package (20) provides a compact, modular design in which a MMIC transceiver, receiver, or transceiver module, for instance, can be integrally packaged with a rectangular waveguide launch. The package (20) is preferably designed to be readily coupled to a standard flange of a rectangular waveguide device (25) such that the waveguide port on surface (21*b*) is aligned to and interfaces with the waveguide cavity of the rectangular waveguide device (25). For instance, the package (20) can readily interface to a standard WR15 waveguide flange.

It is to be understood that the exemplary embodiments of FIGS. 1A~1C and 2 are high-level schematic illustrations of methods for constructing and packaging waveguide transitions for various applications and operating frequencies. For instance, transition structures, which are based on the above-described general frameworks, will be discussed in further detail with reference to FIGS. 3A~3D, 4A~4C, 5A~5C and 6-9, for MMW applications (e.g., wideband operation over 50-70 GHz for WR15 rectangular waveguide). Waveguide transitions according to exemplary embodiments of the invention have a common architecture based on a waveguide block with an inner waveguide channel and a substrate based feed structure with the printed probe inserted into an opening in a broad wall of the waveguide channel. As will be explained below, various techniques according to exemplary embodiments of the invention are employed to design waveguide transitions providing low loss and wide bandwidth operation in a manner that is robust and relatively insensitive to manufacturing tolerances and operating environment, while allowing ease of assembly.

In one exemplary embodiment, transition structures are designed with off-centered positioning of the transition substrate (with the printed feed and probe) along the broad wall of the rectangular waveguide channel. With conventional, E-plane probe designs, transitions are constructed having a symmetrical arrangement where the probe insertion point is the center of the broad side wall of the waveguide. However, this conventional technique usually does not lead to the optimal position, thus, resulting in a high input reactance limiting the bandwidth, especially for an E-plane probe loaded by a thick high dielectric permittivity substrate.

It has been investigated that an offset launch can achieve a lower input reactance over a wide frequency band, thereby allowing a broader match. The low input reactance of the offset launch can be attributed to the significant reduction of the amplitudes for high order evanescent modes, being a result of the filter perturbation in the uniform rectangular waveguide by a dielectric loaded probe. Advantageously, an offset launch can eliminate the need for additional matching structures, which allows more compact solutions. Indeed, exemplary transition structures according to the invention do not require additional matching components that extend out of the waveguide walls. Indeed, in exemplary embodiments described below, probe transitions can be directly feed by uniform CPW or ACPS/CPS transmission lines while achieving desired performed over, e.g., the entire WR15 frequency band.

In other exemplary embodiments of the invention, transition substrates with printed feed lines and probe transitions are designed with features that suppress undesirable higher-order modes of propagation and associated resonance effects that can lead to multiple resonance like effects at MMW frequencies by virtue of a conductor backed environment provided by the metallic waveguide walls. In particular, exemplary transition are designed to suppress undesired CSL (coupled slotline), microstrip-like and parallel waveguide modes, which could be generated due to electrically wide transition substrate with a printed feed line being disposed in a wide opening (transition port $P_T$), where the entire, or a substantial portion of, the transition substrate with the printed feed line is enclosed/surrounded by metallic sidewall surfaces in the transition port $P_T$ opening. As described in detail below, edge-wrap metallization and castellations in the form of half-vias or half-slots may be used to locally wrap upper and lower conductors (e.g, ground conductors) on opposite substrate surfaces of CPW or CPS/ACPS feed lines, which are disposed within the waveguide walls. Such solutions allow for effective connection of top and bottom conductors located on opposite surfaces of the transition substrate, independently of the substrate dicing tolerances and other manufacturing tolerances (e.g., finite radius of corners within the transition port opening). window.

Transition structures that are based on the above-described general frameworks, will now be discussed in further detail with reference to FIGS. 3A~3D, 4A~4C, 5A~5C and 6-9, for MMW applications. In general, FIGS. 3A~3D illustrate an exemplary embodiment of a transition housing (or waveguide block) for use with a CPW-based feed structure and E-plane probe transition (FIG. 4A~4C) or stripline-based feed structure and E-plane probe transition (FIG. 5A~5C). Moreover, FIGS. 6-9 illustrate various embodiments for constructing conductor backed and non conductor backed CPW and CPS feed lines using half-via edge wrapping metallization for suppressing undesired modes and resonances.

Figure 3A:
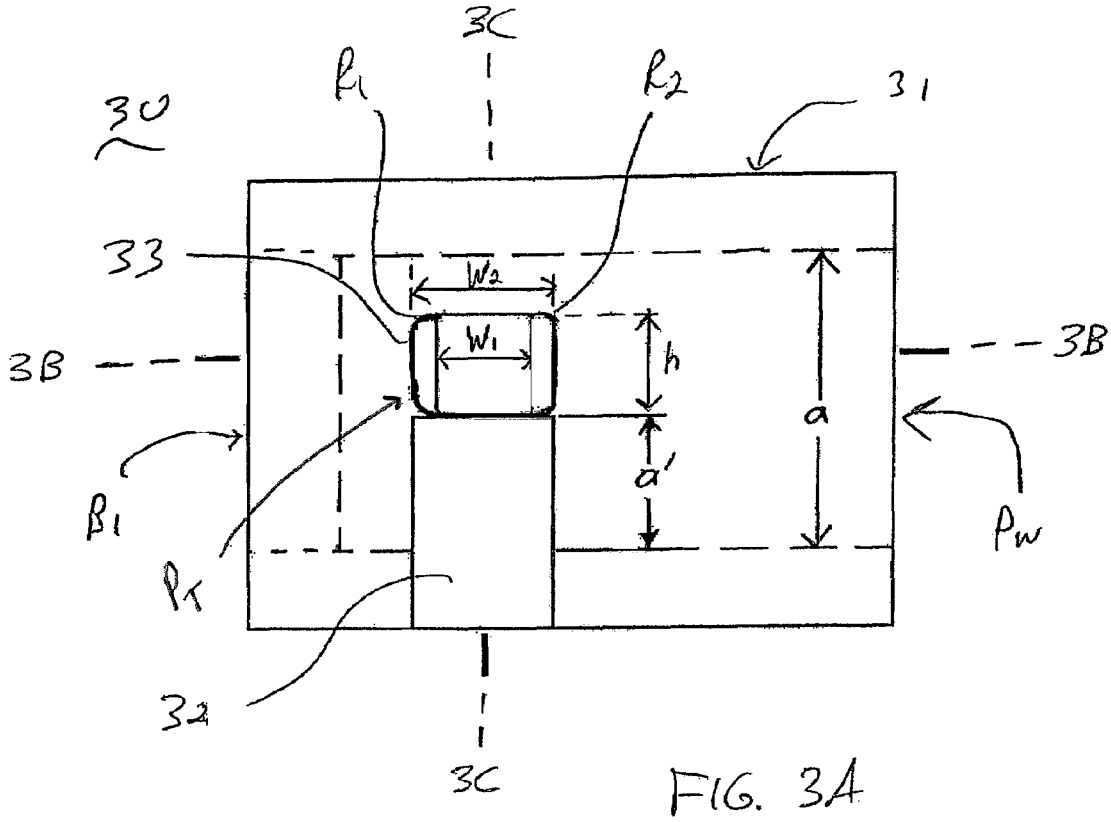
FIGS. 3A~3D illustrate structural details of a metallic transition housing (30) according to an exemplary embodiment of the invention
Figure 3B:
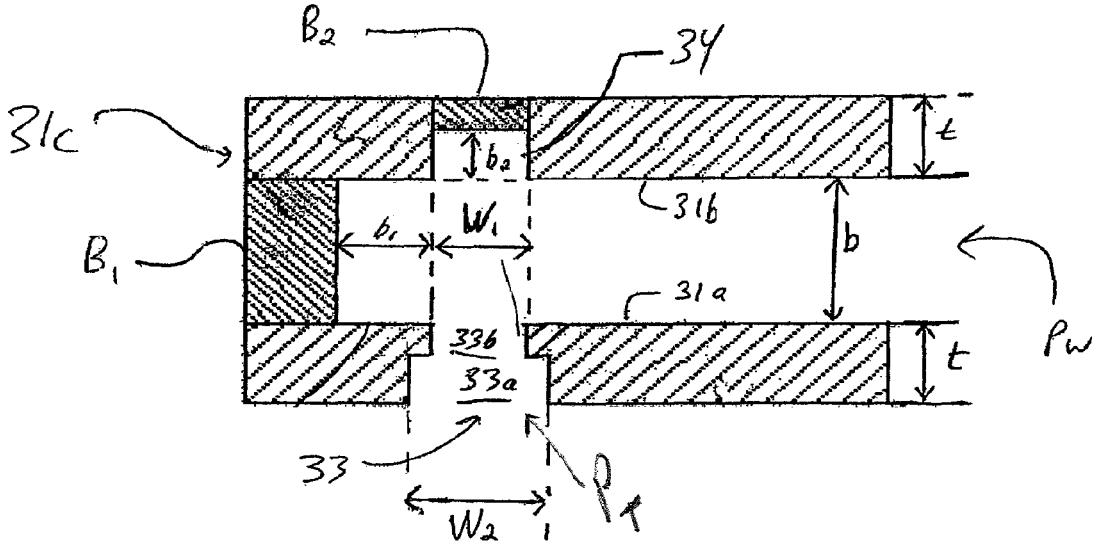
Figure 3C:
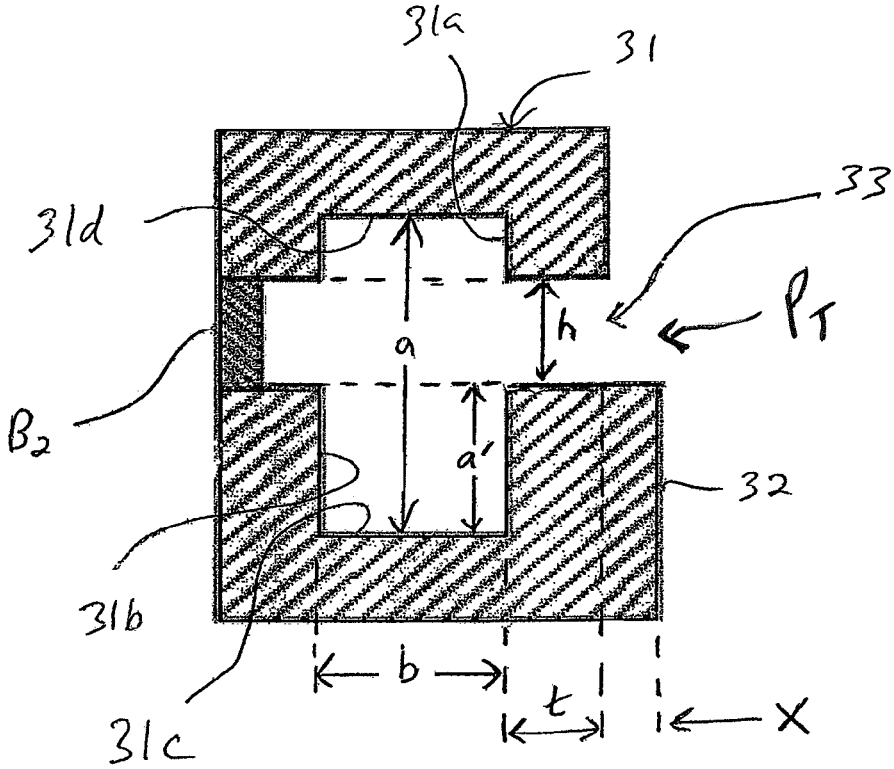
Figure 3D:
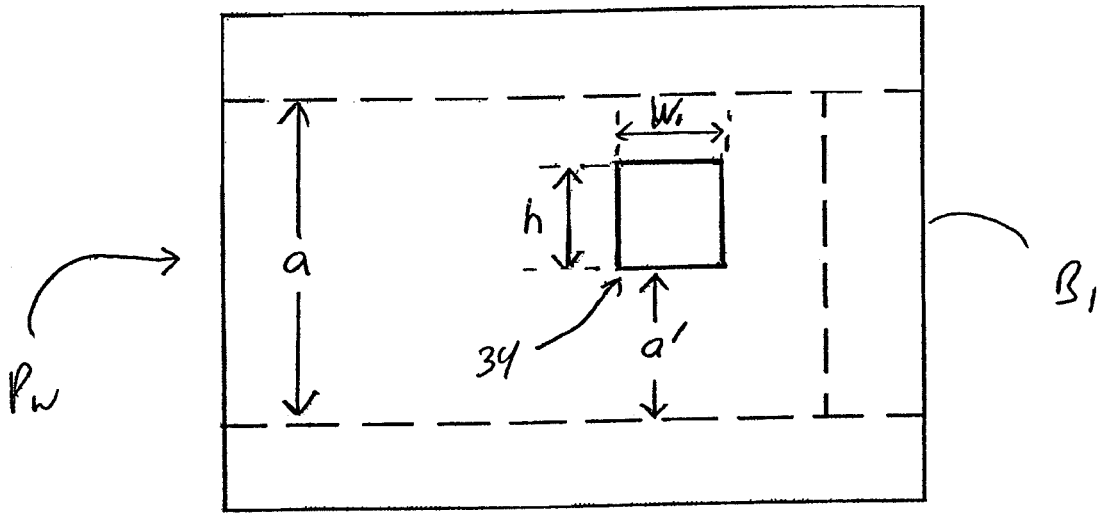

More specifically, FIGS. 3A~3D illustrate structural details of a metallic transition housing (30) according to an exemplary embodiment of the invention. FIG. 3A illustrates a front view of the exemplary transition housing (30) which generally comprises a waveguide housing (31) and a substrate support block (32). FIG. 3B is a cross sectional view of the transition housing (30) along line 3B-3B in FIG. 3A and FIG. 3C is a cross-sectional view of the transition housing (30) along line 3C-3C in FIG. 3A. FIG. 3D is a back view of the transition housing (30) (opposite the front view of FIG. 3A). The transition housing (30) can be formed of bulk copper, aluminum or brass, or any other appropriate metal or alloy, which can be silver plated or gold plated to enhance conductivity or increase resistance to corrosion. The transition housing (30) can be constructed using known split-block machining techniques and/or using the wire or thick EDM (electronic discharge machining) techniques for dimensional precision required at millimeter wave frequencies. In other exemplary embodiments, the transition housing can be formed of a plastic material using precise injection mold technique for cost reduction purposes. With plastic housings, the relevant surfaces (e.g., broad and short wall surfaces of the rectangular waveguide channel) can be coated with a metallic material using known techniques.

As generally depicted in FIGS. 3A~3D, the waveguide block (31) includes an inner rectangular waveguide channel (shown in phantom by dotted lines in 3A and 3D) having width=a and height=b defined by inner surfaces of the front/back broad walls (31*a*)/(31*b*), and the bottom/top short walls (31*c*)/(31*d*) of the waveguide block (31). The front and back broad walls (31*a*) and (31*b*) are depicted as having a thickness, t. The waveguide channel is open-ended on one side wall of the waveguide block (31) to provide a waveguide port $P_w$. The other end of the waveguide channel is closed (short-circuited) by a backshort B1 component. In one exemplary embodiment of the invention, the backshort B1 is a separately machined component that is designed to be inserted into the end of the waveguide channel allowing adjustment of the backshort distance $b_1$ between the probe transition and the inner surface of the backshort B1 (as depicted in FIG. 3B) for tuning and matching the waveguide and transition. In such case, the inner rectangular waveguide channel would be formed with open ends on each side wall of the waveguide block (31).

An aperture (33) is formed through the front broad wall (31*a*) of the waveguide block (31) to provide a transition port $P_T$ for inserting a dielectric substrate with a printed transmission line and probe transition. The aperture (33) is formed having a height h and having a step-in-width feature including an inner opening (33*b*) of width $W_1$ and an outer wall opening (33*a*) of width $W_2$. The bottom of the aperture (33) is formed at a height a' from the inner surface of the bottom short wall (31*c*). The bottom inner surface of the aperture (33) is coplanar with the upper surface of the substrate support block (32) which extends at a distance x (see FIG. 3C) from the front surface of the waveguide block (31). The aperture (33) and support block provide a coplanar mounting surface of length t+x for supporting a planar transition substrate. The step-in-width structure of the aperture (33) provides a mechanism for accurate, self-alignment and position of a transition substrate with printed feed and transition within the waveguide aperture and cavity without using a split-block technique (no visual inspection needed). As explained below, the transition substrates are formed with a matching step-in-width shape structure enabling alignment and positioning in the aperture (33) If a split-block technique is applied for positioning the transition substrate with the probe within the waveguide aperture, the aperture (33) can be formed with a uniform narrow opening, e.g., having width $W_1$ of the inner opening (33*b*).

A tuning cavity (34) (or tuning stub) is formed on the broad wall (31*b*) of the waveguide channel opposite the transition port aperture (33). As depicted in FIG. 3D, the tuning cavity (34) is essentially an opening formed in the broad wall (31*b*) in the waveguide channel, which is aligned to the inner opening (33*b*) of the aperture (33) and having the same dimensions $h \times W_1$. In addition, the tuning cavity (34) is short-circuited using a separately machined backshort element B2 that can be adjustably positioned at a distance $b_2$ from the opening of the tuning cavity (34) (i.e., from the inner surface of the broad wall (31*b*)). The tuning cavity (34) with adjustable backshort B2 provides an additional tuning mechanism for matching the characteristic impedance of the waveguide port and the characteristic impedance of the printed feedline and probe transition.

In one exemplary embodiment, the tuning cavity (34) and inner opening (33*b*) of the aperture (33) can be created together in a single manufacturing step using wire EDM machining to machine through the entire width of the metal block that is milled to form the transition housing (30). The narrower opening (33*b*) (width $W_1$) can be machined using an EDM technique for precision, while the wider opening (33*a*) (width $W_2$) can be formed using classical techniques with less precision since the dimensional accuracy for $W_2$ has minor influence on the transition performance. A thick EDM process may be used to form the opening (33) when the tuning cavity (34) is not desired.

In exemplary transition designs, when forming the transition port $P_T$ in the broad wall, there are inherent limitations for machining techniques (even as precise as EDM) which can not provide square openings—the machining results in openings with finite radius corners (denoted as "$R_1$" and "$R_2$" in FIG. 3A). For instance, wire EDM techniques yield openings with a corner radius of 4-5 mils, wherein thick EDM techniques can yield opening with a smaller corner radius of 2 mils. Because of these inherent limitations, the aperture (33) openings are formed with rounded corners. As such, a transition substrate would have to be made smaller than the aperture width ($W_1$, $W_2$), or the transition substrate would not seat properly and contact the inner side wall surfaces.

Figure 4A:
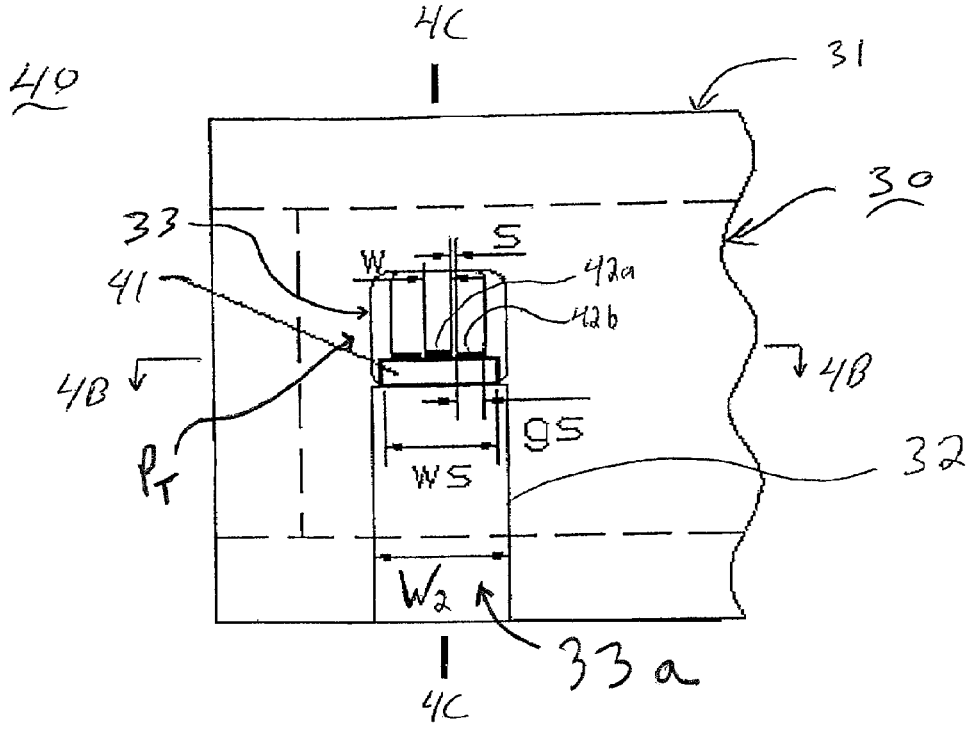
FIGS. 4A~4C are schematic perspective views of a transmission line to waveguide transition apparatus according to an exemplary embodiment of the invention.
Figure 4B:
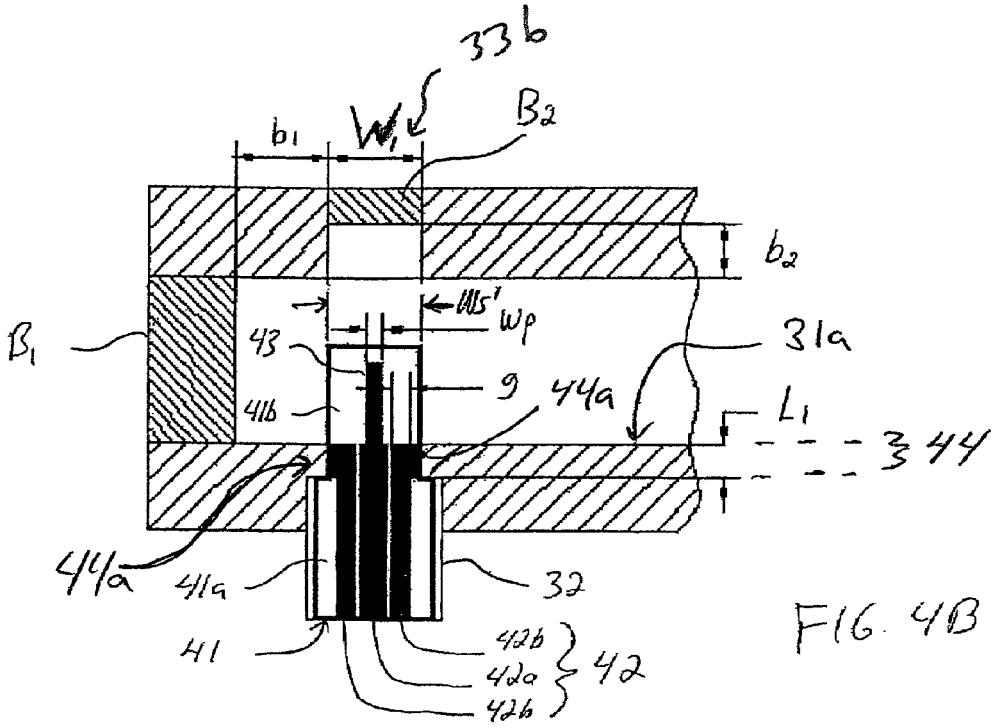
Figure 4C:
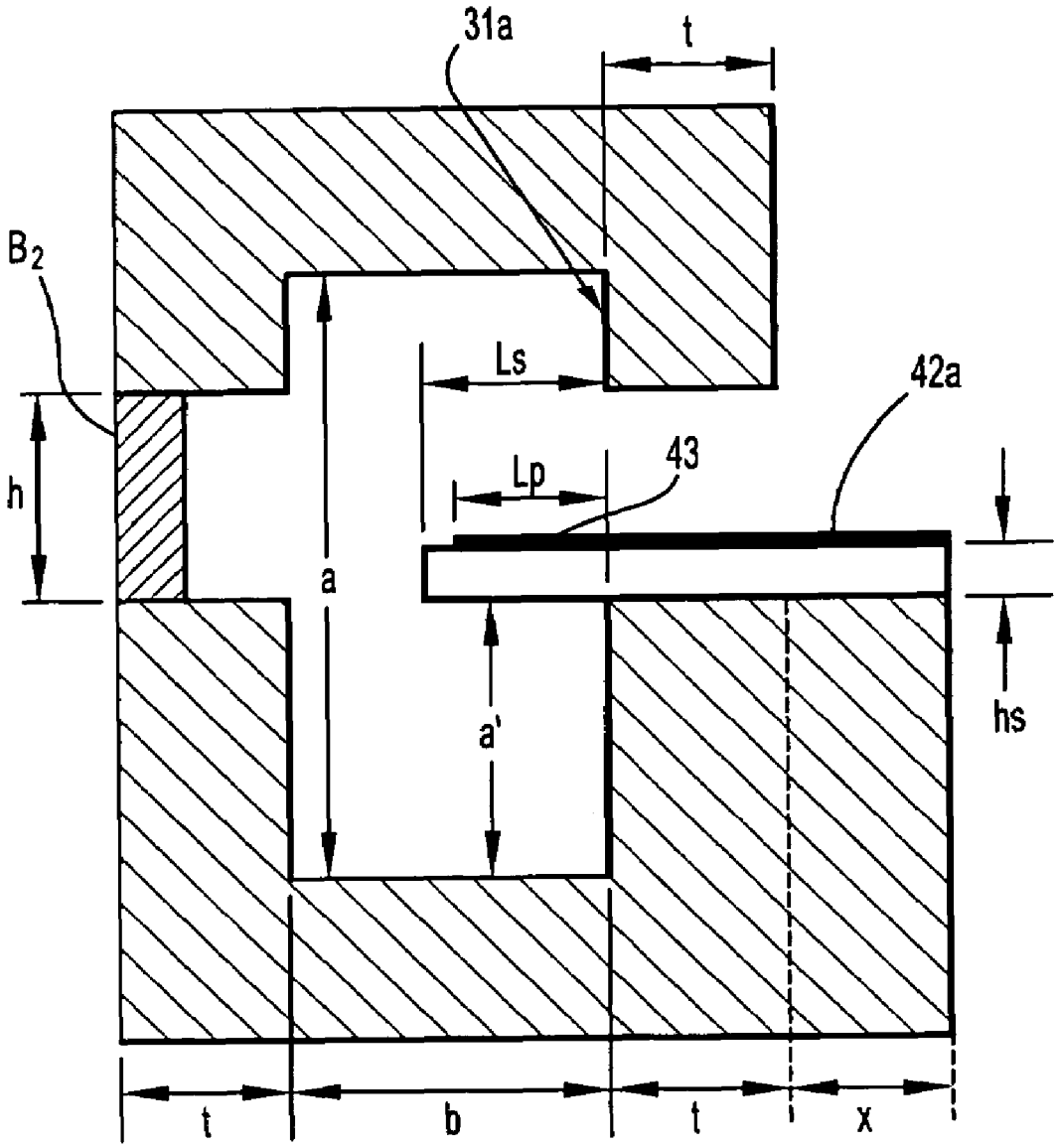
Figure 5A:
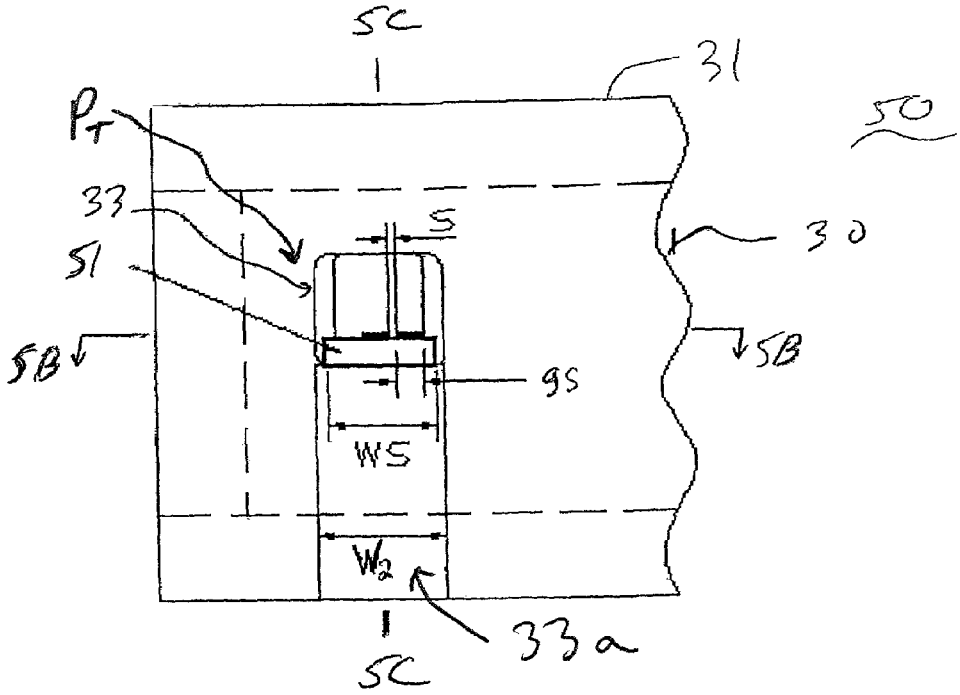
FIGS. 5A~5C are schematic perspective views of a transmission line to waveguide transition apparatus according to an exemplary embodiment of the invention.
Figure 5B:
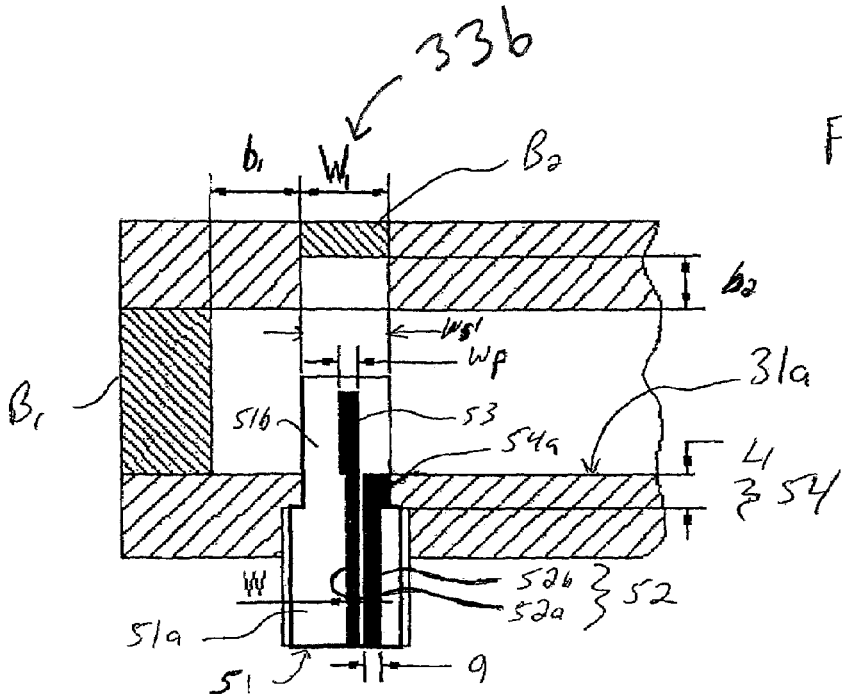
Figure 5C:
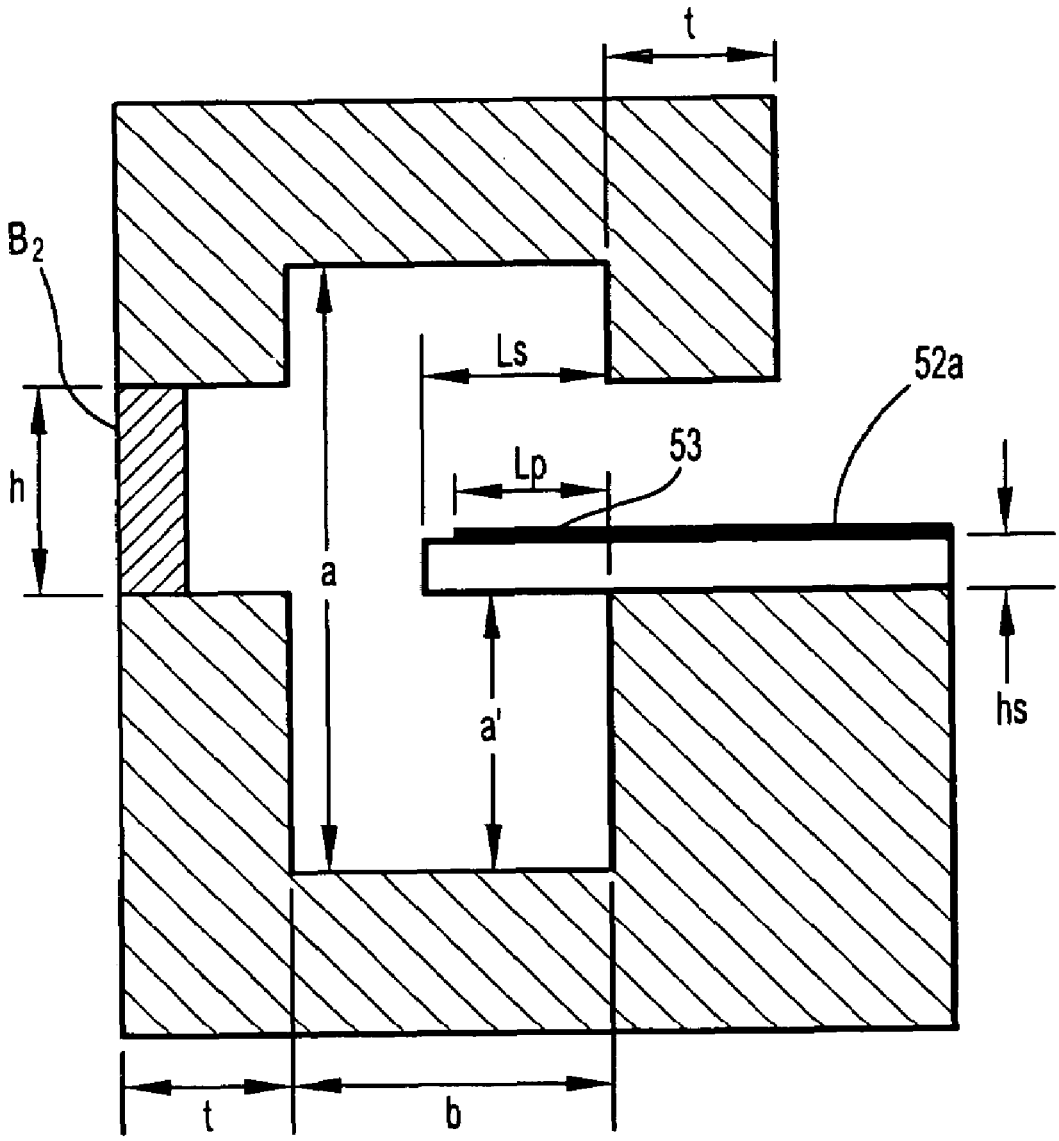

FIGS. 4A~4C are schematic perspective views of a transmission line to waveguide transition apparatus according to an exemplary embodiment of the invention. In particular, FIGS. 4A~4C illustrate an exemplary CPW-to-rectangular waveguide transition apparatus (40) that is constructed using the exemplary metallic transition housing (30) (as described with reference to FIGS. 3A~3D) and a planar transition substrate (41) comprising a printed CPW transmission line (42) and E-plane probe (43). FIG. 4A illustrates a front view of the exemplary transition apparatus (40) with the transition substrate (41) positioned in the aperture (33) (transition port $P_T$). FIG. 4B is a cross sectional cut view of the transition apparatus (40) along line 4B-4B in FIG. 4A and FIG. 4C is a cross-sectional cut view of the transition apparatus (40) along line 4C-4C in FIG. 4A.

The transition substrate (41) comprises planar substrate having a stepped width structure comprising a first portion (41*a*) of width Ws and a second portion (41*b*) of reduced width Ws', which provides self-aligned positioning of the substrate (41) with the stepped width aperture (33). In the exemplary embodiment, the width Ws of the substrate portion (41*a*) is slightly less than the width $W_2$ of the outer portion (33*a*) of the aperture (33) and the width Ws' of the substrate portion (41*b*) is slightly less than the width $W_1$ of the inner portion (33*b*) of the aperture (33), which takes into account the rounding corners of the inner and outer openings (33*a*) and (33*b*) as explained above.

The substrate (41) comprises top surface metallization that is etched to form the CPW transmission line (42) on the substrate portion (41*a*) and planar transition with the E-plane probe (43) on the substrate portion (41*b*). The substrate portion (41*b*) further includes a transition region (44) where the CPW transmission line (42) is coupled to the probe (43). In the exemplary embodiment, the transition region (44) can be considered the region located between the walls of the inner opening (33*b*) of the aperture (33) and bounded by the inner surface (31*a*) of the broad wall of the waveguide block (31) and the interface between the inner and outer openings (33*b*) and (33*a*).

The CPW transmission line (42) includes three parallel conductors including a center conductor (42*a*) of width w, which is disposed between two ground conductors (42*b*) of width g, and spaced apart from the ground conductors (42*b*) at distance s. The probe (43) is depicted as a rectangular strip of width Wp and length Lp, which is connected to, and extends from the end of the center conductor (42*a*) of the CPW (42). The end of the substrate portion (41*b*) extends at a distance Ls from the inner surface (31*a*) of the waveguide broad wall (31), where Ls is greater than Lp. The ground conductors (42*b*) of the CPW (42) are terminated by stubs (44*a*) of width gs in the transition region (44), where stubs essentially form a 90 degree bend from the end of the ground conductors (42*b*) toward the sidewalls of the substrate adjacent the metallic walls of the inner opening (33*b*) of the aperture (33).

FIGS. 5A~5C are schematic perspective views of a transmission line to waveguide transition apparatus according to another exemplary embodiment of the invention. In particular, FIGS. 5A~5C illustrate an exemplary ACPS-to-rectangular waveguide transition apparatus (50) that is constructed using the exemplary metallic transition housing (30) (as described with reference to FIGS. 3A~3D) and a planar transition substrate (51) comprising a printed ACPS transmission line (52) and E-plane probe (53). FIG. 5A illustrates a front view of the exemplary transition apparatus (50) with the transition substrate (51) positioned in the aperture (33) (transition port $P_T$). FIG. 5B is a cross sectional cut view of the transition apparatus (50) along line 5B-5B in FIG. 5A and FIG. 5C is a cross-sectional cut view of the transition apparatus (50) along line 5C-5C in FIG. 5A.

The transition substrate (51) comprises planar substrate having a stepped width structure comprising a first portion (51*a*) of width Ws and a second portion (51*b*) of reduced width Ws', which provides self-aligned positioning of the substrate (51) with the stepped width aperture (33). In the exemplary embodiment, the width Ws of the substrate portion (51*a*) is slightly less than the width $W_2$ of the outer portion (33*a*) of the aperture (33) and the width Ws' of the substrate portion (51*b*) is slightly less than the width $W_1$ of the inner portion (33*b*) of the aperture (33), which takes into account the rounding corners of the inner and outer openings (33*a*) and (33*b*) as discussed above.

The substrate (51) comprises top surface metallization that is etched to form the CPS transmission line (52) on the substrate portion (51*a*) and planar transition with the E-plane probe (53) on the substrate portion (51*b*). The substrate portion (51*b*) further includes a transition region (54) where the CPS transmission line (52) is coupled to the probe (53). In the exemplary embodiment, the transition region (54) can be considered the region located between the walls of the inner opening (33*b*) of the aperture (33) and bounded by the inner surface (31*a*) of the broad wall of the waveguide block (31) and the interface between the inner and outer openings (33*b*) and (33*a*).

The CPS transmission line (52) includes two parallel conductors including a first conductor (52*a*) of width w, and a second conductor (52*b*) of width g, and spaced apart at distance s. When the widths of the conductors (52*a*) and (52*b*) are the same (w=g), the transmission line (52) is referred to as a CPS line, which can support a differential signal where neither conductor (52*a*) or (52*b*) is at ground potential. When the widths of the conductors (52*a*) and (52*b*) are different (e.g., w<g), the transmission line (52) is referred to as an asymmetric CPS (ACPS) line. In the exemplary embodiment, an ACPS feed line is shown, where conductor (52*b*) is a ground conductor. The probe (53) is depicted as a rectangular strip of width Wp and length Lp, which is connected to, and extends from the end of the first conductor (52*a*) of the feed line (52). The substrate portion (51*b*) extends at a distance La from the inner surface (31*a*) of the waveguide broad wall (31), where Ls is greater than Lp. The ground conductor (52*b*) is terminated by a stub (54*a*) of width gs in the transition region (44), where the stub essentially forms a 90 degree bend from the end of the conductor (52*b*) to the substrate side wall adjacent to the metallic wall of the inner opening (33*b*) of the aperture (33).

Figure 6:
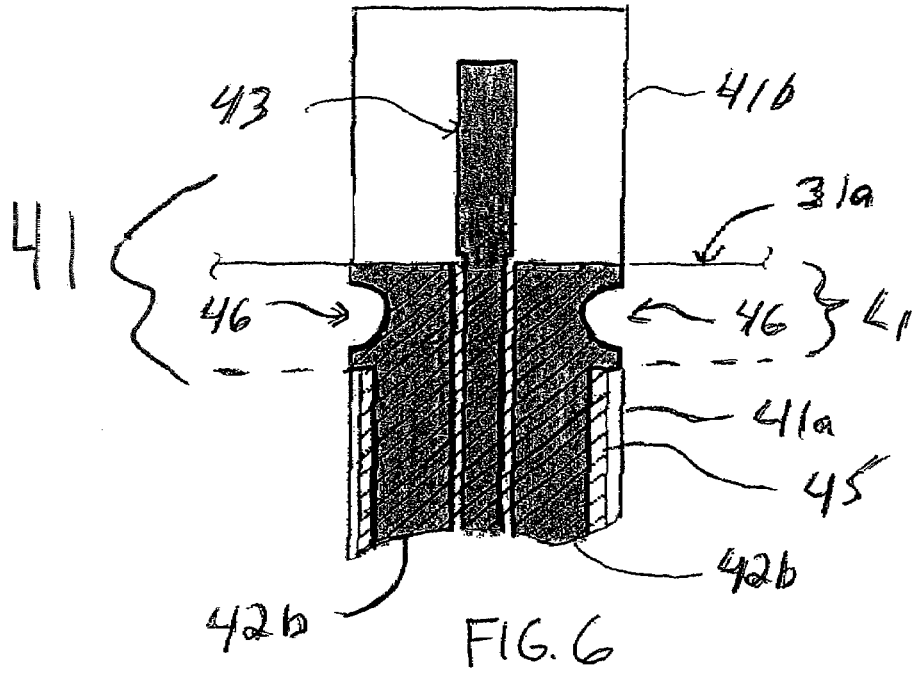
FIG. 6 schematically illustrates a conductor-backed CPW feed structure in which half-via edge wrapping metallization is used for suppressing undesired waveguide modes and resonances, according to an exemplary embodiment of the invention.
Figure 7:
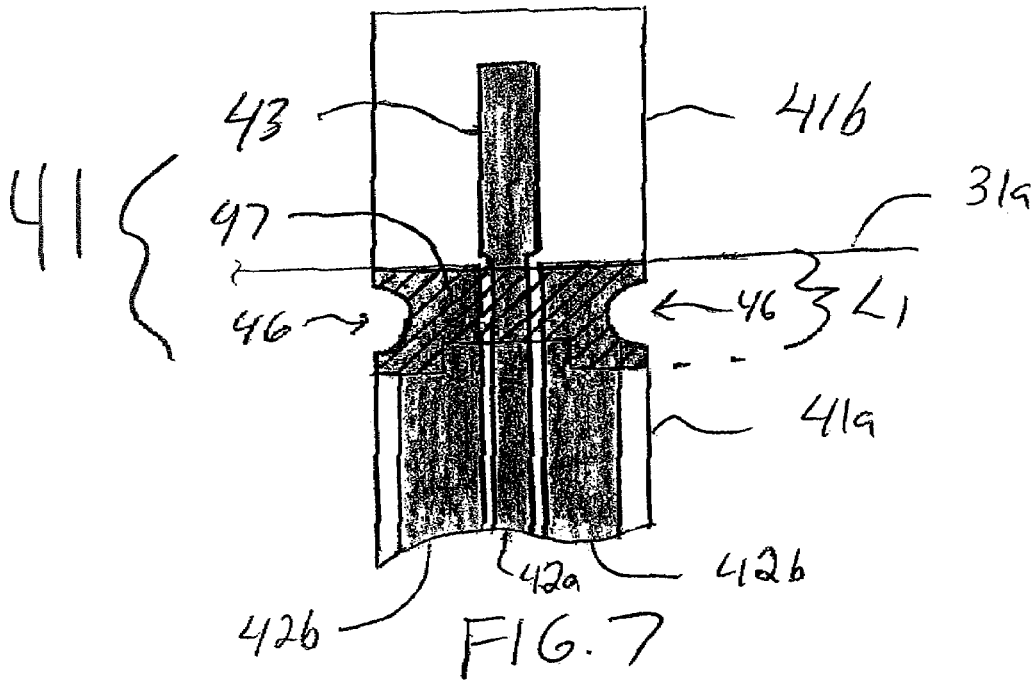
FIG. 7 schematically illustrates a non conductor-backed CPW feed structure in which half-via edge wrapping metallization is used for suppressing undesired waveguide modes and resonances, according to an exemplary embodiment of the invention.
Figure 8:
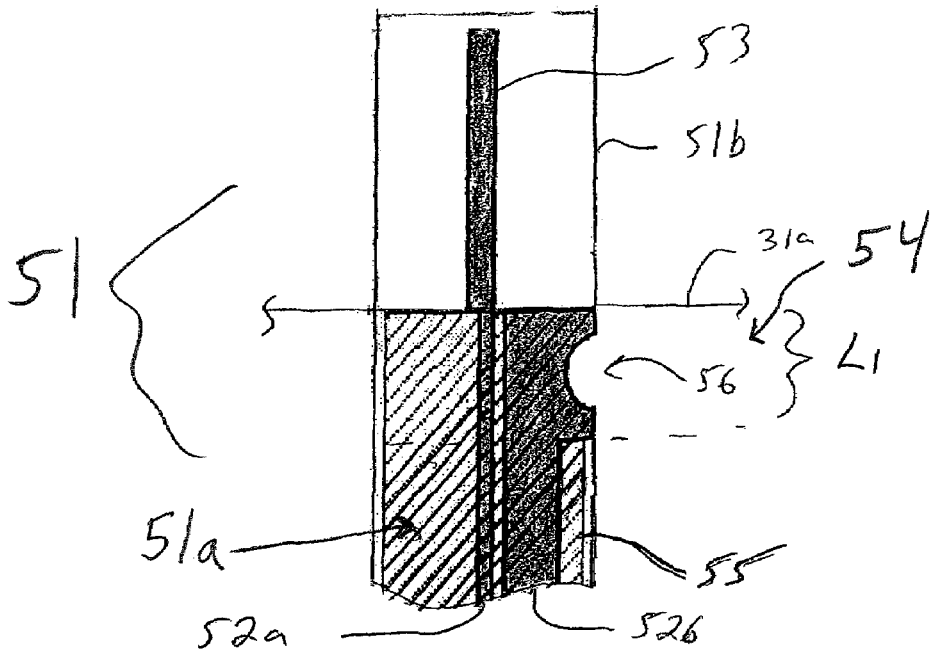
FIG. 8 schematically illustrates a conductor-backed CPS feed structure in which half-via edge wrapping metallization is used for suppressing undesired waveguide modes and resonances, according to an exemplary embodiment of the invention.
Figure 9:
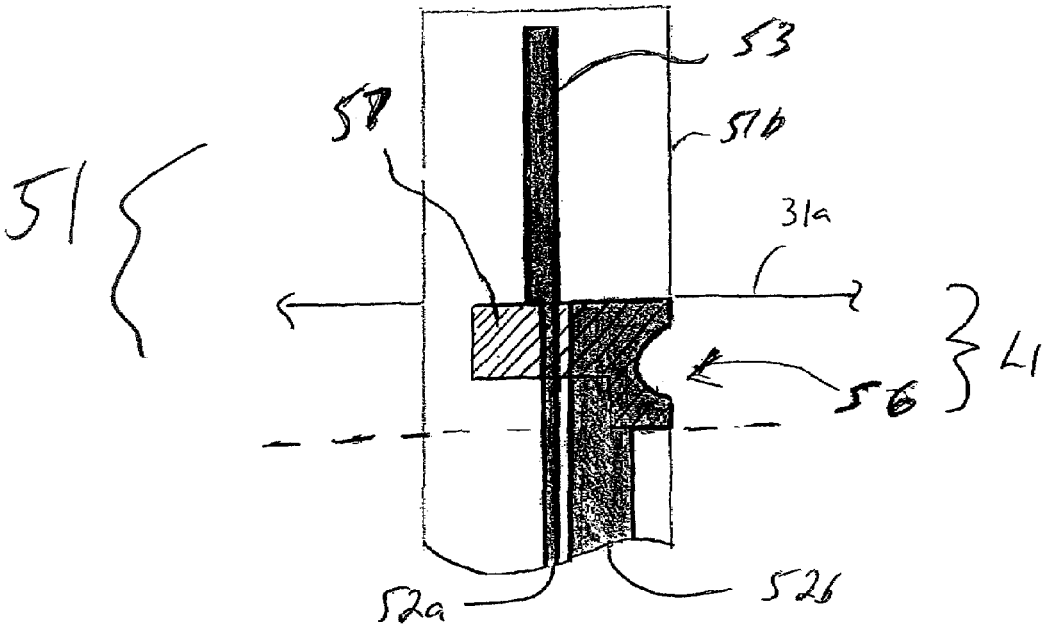
FIG. 9 schematically illustrates a non-conductor-backed CPS feed structure in which half-via edge wrapping metallization is used for suppressing undesired waveguide modes and resonances, according to an exemplary embodiment of the invention.

The exemplary transition carrier substrates (41) and (51) can be constructed with conductor-backed feed line structures with no galvanic isolation from the metallic waveguide walls, or constructed with non-conductor backed feed line structures with galvanic isolation from the metallic waveguide walls. For instance, FIGS. 6 and 8 schematically illustrate exemplary embodiments of the transition carrier substrates (41) and (51) constructed having full ground planes formed on the bottoms thereof to provide conductor-backed CPW and ACPS feed lines structures. Moreover, FIGS. 7 and 9 schematically illustrate exemplary embodiments of the transition carrier substrates (41) and (51) constructed with non conductor-backed CPW and ACPS feed lines structures.

In particular, referring to FIG. 6, the transition carrier substrate (41) has a bottom ground plane (45) that is formed below the substrate portion (41*a*) and the transition region (44) providing a conductor-backed CPW structure. The portion of the substrate (41*b*) below the probe (43) that extends past the inner surface of the broad wall (31*a*) has no ground plane. Similarly, as shown in FIG. 8, the transition substrate (51) has a bottom ground plane (55) that is formed below the substrate portion (51*a*) and the transition region (54) providing a conductor-backed CPS structure. The portion of the substrate (51*b*) below the probe (53) that extends past the inner surface of the broad wall (31*a*) has no ground plane. The transition carrier substrates (41) and (51) can be fixedly mounted in the transition port using a conductive epoxy to bond the ground planes (45), (55) to the metallic waveguide surface (no galvanic isolation). It is to be understood that FIGS. 6 and 8 illustrate an exemplary embodiments in which the transition substrates (41) and (51) in FIGS. 4B and 5B, for example, are formed with a uniform width (i.e., no stepped width as shown in FIGS. 4B and 5B).

The exemplary conductor-backed CB CPW (CB-CPW) and conductor-backed ACPS (CB-ACPS) designs provide mechanical support and heat sinking ability as compared to conventional CPW or ACPS. Moreover, conductor-backing is a natural environment for CPW or CPS feed lines when connecting with waveguides (through the metal walls) being the metal enclosures. However, conductor backed CPW and CPS (CB-CPS) designs are subject to excitation of parallel waveguide and microstrip-like modes at mm-wave frequencies resulting in a poor performance due to mode conversion at discontinuities and the associated resonance-like effects that may result due to the large (electrically large) lateral dimensions of the transition structure. Furthermore, a CPW can support two dominant modes, namely the CPW mode and the CSL (coupled slotline) mode, the latter mode being parasitic in this case. In this regard, methods are provided to suppress high-order modes and resonance effects by wrapping the ground conductors and bottom ground planes of the CB-CPW or CB-CPS feed structures printed on both sides of the substrate carrier.

For example, in the exemplary embodiments of FIGS. 4B and 5B, the local wrapping can be realized by plating techniques over the partial length $L_1$ of the substrate side wall in the transition regions (44) and (54) or by the so-called "half-a-via" wrapping. By way of example, FIG. 6 schematically illustrates a conductor-backed CPW feed structure such as depicted in FIG. 4B, where the end portions of the ground conductors (42*b*) are connected to the ground plane (45) on the bottom of the substrate portion (41*a*) (shown in phantom) along length $L_1$ in the transition region (44) using a half-via edge wrapping metallization (46). Similarly, FIG. 8 schematically illustrates a conductor-backed CPS feed structure such as depicted in FIG. 5B, where the end portion of the ground conductor (52*b*) is connected to a ground plane (55) on the bottom of the substrate portion (51*a*) (shown in phantom) along length $L_1$ in the transition region (54) using a half-via edge wrapping metallization (56). In the exemplary transition designs, the use of via-edge wrapping achieves an effective connection of top and bottom ground elements located on the transition substrates, providing a mode suppression mechanism that is independent of the substrate dicing tolerances and a finite radius $R_1$ and/or $R_2$ of the inner and outer openings (33*a*) and (33*b*) of the aperture (33).

As described above, the exemplary transition structures for conductor-backed feed lines designs may be constructed using edge wrap metallization and electrical connection to connect the upper and lower ground elements on opposite sides of the substrate for mode suppression purposes. With non conductor-backed CPW and CPS designs such as depicted in FIGS. 7 and 9, the transition substrates are attached to the metallic waveguide walls using a non-conductive adhesive.

In the previously described designs with the conductor-backed substrates when attached using non-conductive epoxy, the metallic waveguide walls and the solid metal on the backside of the substrate in effect create a parallel waveguide structure, which can potentially lead to energy leakage and parasitic resonance effects. To avoid this problem, non-conductor-backed CPW and ACPS (or CPS)-to-rectangular waveguide transition structures with galvanic isolation to the metal waveguide block are designed with special mode suppression techniques in which conductive strips are formed on the bottom of the transition substrates and connected to the top ground conductors of the feed structures via edge wrapping. This structure prevents the propagation of both the parallel WG and the other parasitic modes as mentioned above, specific to the conductor-backed designs.

For example, FIG. 7 schematically illustrates a non-conductor-backed CPW feed structure based on the exemplary design shown in FIG. 4B. In this embodiment, the substrate carrier (41) would not be electrically connected to the metallic waveguide housing a conductive bonding material, but rather attached to the metallic waveguide housing by a non-conductive epoxy having well known dielectric properties for the frequency range of interest. In FIG. 7, edge wrapping half-via metallization (46) would be attached to a metallic "ground" pattern (47) on the bottom side of the substrate carrier (41) in the transition region (44) to prevent propagation of parasitic modes as mentioned above. In effect, the bottom metallization patterns (47) would be suspended over (insulated from) the metal surface of the waveguide housing in the apertures by virtue of the non-conductive epoxy bonding the metallic "ground" pattern (47) to the metallic waveguide surface. The metallic "ground" pattern (47) may be patterns to form fingers, the number, position, width and length of the metal fingers (47) and via wrapping (46) would be designed as needed. The designs can have more wrapping points along the length of the feed lines, depending on the required probe length. Of special importance is also the spacing (filled with a non-conductive epoxy) between the bottoms of the substrate and the opening, which is kept low for an exemplary design (e.g., below 50 μm for 60 GHz designs).

Moreover, FIG. 9 schematically illustrates a non-conductor-backed ACPS feed structure based on the exemplary design shown in FIG. 5B. In this embodiment, the substrate carrier (51) would not be electrically connected to the metallic waveguide housing a conductive bonding material, but rather attached to the metallic waveguide housing a non-conductive epoxy having well known dielectric properties for the frequency range of interest. In FIG. 9, edge wrapping half-via metallization (56) would be attached to a metallic "ground" pattern (57) on the bottom side of the substrate carrier (51) in the transition region (54) to prevent propagation of parasitic modes as mentioned above. In effect, the metallic "ground" pattern (57) would be suspended over (insulated from) the metal surface of the waveguide housing in the apertures by virtue of the non-conductive epoxy bonding the metallic "ground" pattern (57) to the metallic waveguide surface. The metallic "ground" pattern (57) may be patterns to form fingers, the number, position, width and length of the metal fingers and via wrapping (56) would be designed as needed. The designs can have more wrapping points along the length, depending on the required probe length. Again, the consideration would be given to the spacing (filled with a non-conductive epoxy) between the bottoms of the substrate and the opening, which is kept low for an exemplary design (e.g., below 50 μm for 60 GHz designs).

In the exemplary transition apparatus (40) and (50) discussed above, various parameters may be adjusted for purpose of matching the waveguide mode to the characteristic impedance of the CPW or ACPS transmission lines. For example, the CPW or ACPS lines can be matched to the waveguide port by adjusting various parameters including, for example, the distance $b_1$ between the probe (43)/(53) and the backshort B1, the location of the probe (43), (53) in the waveguide cross-section a, the probe width Wp and LP. The goal of the optimization is to achieve the highest possible bandwidth (or maximum bandwidth). On the Smith chart, bandwidth is indicated by a frequency dependent "tear drop" shaped input reflection coefficient that loops around its center. The smaller the loop, the better the bandwidth. The reactance of the probe is influenced by the energy stored in the supporting substrate. The substrate height, hs, width Ws and length Ls or dielectric constant has a considerable effect on the reactive part of the input impedance and the achieved bandwidth. In the exemplary embodiments discussed above, the supporting substrate does not completely fill the entire waveguide aperture to minimize loading of the probe. However, the substrate can extend all the way across (or beyond taking advantage of the backshort B2 structure, if present) the waveguide channel.

In view of the tolerance analysis, the performance of the exemplary transitions is sensitive to the probe depth Lp within the waveguide. This may not be an issue when the depth can be controlled within few μm taking advantage of the split-block technique that allows the transition substrate with printed probe to be positioned accurately using visual inspection. In this process, alignment can be readily performed based on the finite size top ground conductors patterned on the substrate carrier, the boundary of which is aligned with the internal edge of the waveguide broadside wall (31*a*). When the transition housing is not fabricated using split-block techniques, the above-mentioned step-in-width alignment mechanism can be appropriately used for positioning purposes, where positioning precision is limited to about 25-30 μm and is based on the EDM machining accuracy of the length $L_1$ of the narrow opening (33*b*) of the aperture (33).

The aperture (33) that is formed in the broad wall of the waveguide and the proximity of the feed structure operate to perturb the electric field distribution in the vicinity of the probe and, thus, affecting the input impedance of the probe. In this regard, the parameters such as a window width $W_2$ and height h, the strip width w and slot width s for both the CPW and ACPS feeds, and the location of the probe within the opening for the ACPS feed, are additional parameters that influence the input impedance at the CPW and ACPS port.

The size of the opening in the waveguide broadside wall with the inserted feed structure is also of considerable importance, especially for the electrically wide substrate carriers. Due to the classical substrate handling and dicing limitations, most of the substrates fall into that group at 60 GHz and beyond. Thus, the substrate and port opening dimensions are selected so as to not launch the waveguide modes and the associated resonance effects within a dielectrically loaded opening.

Another factor to be considered is an overall width (including top ground conductor widths) of the feed line in the locations where the top and bottom ground conductors are not wrapped. When feed structures are too wide, stationary resonance-like effects in the transmission at some frequencies will occur due to an asymmetric field excitation at the discontinuities.

Other exemplary features of transition structures according to the invention is that such features can be used within metal enclosures without affecting its performance because it is inherently shielded by the waveguide walls. Moreover, the apertures (substrate port $P_T$) formed in the broadside wall can optionally be sealed.

To illustrate the properties of the considered transitions, computer simulations were performed for various CPW-to-waveguide-transition structures and an ACPS-to-waveguide transition structures designed for wideband operation (50-70 GHz) for WR15 rectangular waveguides. The simulations were performed using a commercially available 3D EM simulation software tool for RF, wireless, packaging, and opto-electronic design, in particular, the HFSS (3D full-wave FEM solver) tool. All loss mechanisms (ohmic, dielectric and radiation) and coupling effects in-between the modes were taken into account. A 3D 4 μm thick gold metallization with a perfect surface finish (no roughness) was used as conducting layer. Surface impedance formulation is used to account for ohmic losses which is well justified at the frequency range of interest (50-70 GHz). The feed lines with probes are placed on a 300 um thick fused silica substrate (dielectric permittivity of 3.8) which is relatively thick for 50-70 GHz frequency band. In exemplary embodiments of the invention, the portion of the substrate beneath the planar probe may be thinned or removed to improve performance of exemplary transition structures described herein. A thick substrate can be chosen for better mechanical stability of the designs. The dimensional parameters for exemplary transition designs are listed in Table I below. The results of the simulation indicated that the exemplary transition designs would yield very low insertion loss and return loss within the entire frequency range of interest.

TABLE 1

EXEMPLARY DIMENSIONAL PARAMETERS FOR TRANSITION DESIGNS AT WR15 BAND

| Param. [mm] | Design 1 (CPW) | Design 2 (CPW) | Design 3 (CPW) | Design 1 (CPS) |
|---|---|---|---|---|
| $b_1$ | 1.05 | 1.05 | 1.05 | 0.95 |
| $b_2$ | 0.6 | 0.3 | 0.6 | 0 |
| $W_1$ | 1.02 | 1.02 | 1.02 | 1.02 |
| $L_1$ | 0.4 | 0.4 | 0.4 | 0.4 |
| $W_2$ | 1.5 | 1.5 | 1.5 | 1.5 |
| t | 1 | 1 | 1 | 1 |
| h | 0.8 | 0.8 | 1.3 | 1.3 |
| a' | 1.729 | 1.729 | 1.579 | 1.579 |
| Lp | 0.88 | 0.88 | 0.88 | 1.18 |
| Wp | 0.15 | 0.15 | 0.15 | 0.13 |
| Ls | 1.1 | 1.1 | 1.1 | 1.25 |
| $Ws' = W_1$ | 1.02 | 1.02 | 1.02 | 1.02 |
| w | 0.15 | 0.15 | 0.15 | 0.055 |
| s | 0.02 | 0.02 | 0.02 | 0.045 |
| gs | 0.415 | 0.415 | 0.415 | 0.395 |
| g | 0.315 | 0.315 | 0.315 | 0.28 |
| Ws | 1.5 | 1.5 | 1.5 | 1.5 |

Although exemplary embodiments have been described herein with reference to the accompanying drawings for purposes of illustration, it is to be understood that the present invention is not limited to those precise embodiments, and that various other changes and modifications may be affected herein by one skilled in the art without departing from the scope of the invention.

We claim:

1. A transition apparatus, comprising:

a transition housing comprising a rectangular waveguide channel and an aperture disposed through a broad wall of the rectangular waveguide channel;

a substrate having a first surface and a second surface opposite the first surface, and a transmission line and a probe disposed on the first surface, wherein the transmission line comprises a first conductive strip and a second conductive strip, wherein the probe is connected to, and extends from, an end of the first conductive strip, and wherein an end of the second conductive strip is terminated by a stub, and wherein the stub is connected to a conductive ground pattern on the second surface of the substrate by edge-wrap metallization, wherein the substrate is positioned in the aperture such that the probe protrudes into the rectangular waveguide channel and wherein the ends of the first and second conductive strip-terminate at an inner surface of the broad wall of the rectangular waveguide channel, wherein the aperture has a stepped-width opening to enable alignment and positioning of the substrate in the aperture and the rectangular waveguide channel.

2. The transition apparatus of claim 1, wherein one end of the rectangular waveguide channel is close-ended and provides a backshort for the probe.

3. The transition apparatus of claim 2, wherein the backshort is adjustable.

4. The transition apparatus of claim 2, wherein one end of the rectangular waveguide channel is opened on a mating surface of the transition housing, wherein the mating surface can interface with a rectangular waveguide flange.

5. The transition apparatus of claim 1, wherein the transmission line is a coplanar stripline (CPS).

6. The transition apparatus of claim 1, wherein the transmission line is an asymmetric coplanar stripline (ACPS).

7. The transition apparatus of claim 1, wherein the transmission line is a coplanar waveguide (CPW).

8. The transition apparatus of claim 1, wherein the conductive ground pattern on the second surface of the substrate is bonded to a metal surface of the transition housing.

9. The transition apparatus of claim 1, further comprising a tuning cavity provided on a second broad wall of the rectangular waveguide channel opposite and aligned to the aperture.

10. The transition apparatus of claim 1, wherein the transition housing is comprised of a block of metallic material.

11. The transition apparatus of claim 1, wherein the transition housing is comprised of a plastic material having surfaces that are coated with a metallic material.

12. The transition apparatus of claim 1, wherein the stub terminates at the inner surface of the broad wall and extends from the inner surface of the broad wall to be aligned with an outer surface of the stepped-width opening.

13. The transition apparatus of claim 1, wherein the edge wrap metallization is galvanically isolated from the metallic transition housing.

14. The transition apparatus of claim 1, wherein the transition apparatus is integrally packaged with a monolithic microwave integrated circuit (MMIC).

* * * * *